US011776514B1

(12) United States Patent
Lattanzio

(10) Patent No.: US 11,776,514 B1
(45) Date of Patent: Oct. 3, 2023

(54) HYBRID MATERIAL CONSTRUCTION OF STRING INSTRUMENTS TO REDUCE WEIGHT

(71) Applicant: Santiago Lattanzio, Weston, FL (US)

(72) Inventor: Santiago Lattanzio, Weston, FL (US)

( * ) Notice: Subject to any disclaimer, the term of this patent is extended or adjusted under 35 U.S.C. 154(b) by 0 days.

(21) Appl. No.: 17/692,296

(22) Filed: Mar. 11, 2022

(51) Int. Cl.
*G10D 3/22* (2020.01)
*G10D 1/08* (2006.01)

(52) U.S. Cl.
CPC ..... *G10D 3/22* (2020.02); *G10D 1/085* (2013.01)

(58) Field of Classification Search
CPC ..... G10D 3/22; G10D 1/085
See application file for complete search history.

(56) References Cited

U.S. PATENT DOCUMENTS 1,719,680 A * 7/1929 Warner ..... G10D 3/22 84/192
2,575,293 A * 11/1951 Petek ..... G10D 3/22 52/793.11
3,669,214 A * 6/1972 Matsuura ..... G10D 3/22 84/452 P
4,359,923 A * 11/1982 Brunet ..... G10D 1/085 984/107
4,573,391 A * 3/1986 White ..... G10D 1/08 984/106
6,188,005 B1 * 2/2001 White ..... G10D 1/08 84/293
6,233,825 B1 * 5/2001 DeGroot ..... G10D 3/02 29/896.22
6,770,804 B2 * 8/2004 Schleske ..... G10C 3/06 84/290
7,544,872 B1 * 6/2009 Trussart ..... G10D 1/085 84/291
8,378,192 B1 * 2/2013 Harmon ..... G10D 1/085 84/327
8,829,318 B1 * 9/2014 DeLaFrance ..... G10D 1/085 84/292
9,165,539 B2 * 10/2015 Ostosh ..... G10D 1/085
9,208,756 B2 * 12/2015 Isaac ..... G10D 1/085
9,607,588 B2 * 3/2017 Austin ..... G10D 3/22
9,911,401 B2 * 3/2018 Austin ..... G10D 3/02
11,145,279 B2 * 10/2021 Planet Ylla ..... G10H 3/18
2014/0345441 A1 * 11/2014 Ostosh ..... G10D 3/02 84/723
2015/0101473 A1 * 4/2015 Seal ..... G10D 1/08 84/291
2022/0108671 A1 * 4/2022 Dickinson ..... G10D 3/22

* cited by examiner

*Primary Examiner* — Robert W Horn
(74) *Attorney, Agent, or Firm* — THE RAPACKE LAW GROUP, P.A.; Andrew Rapacke; Andrew S. Rapacke

(57) ABSTRACT

A hybrid-material construction for string instruments may include providing an internal lattice framework structure encased in a composite material to produce a final form of a string instrument. The framework structure may provide a lightweight structural support system within a finished instrument to reduce overall weight while maintaining strength of the instrument.

18 Claims, 3 Drawing Sheets

HYBRID MATERIAL CONSTRUCTION OF STRING INSTRUMENTS TO REDUCE WEIGHT

TECHNICAL FIELD

The embodiments described herein generally relate to hybrid-material construction methods for instruments.

BACKGROUND

Common construction methods for instruments, and particularly string instruments, includes using solid wood either as a block or in a layered arrangement in order to create the solid body of a string instrument such as a guitar. Alternative methods may include solid composite arrangements such as carbon fiber, or fiber and resin arrangements.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

In general, the embodiments described herein relate to a hybrid-material construction for string instruments that may include an internal lattice framework structure encased in a composite material to produce a final form of a string instrument. The internal framework may consist of rods, beams, posts, tubes, columns, or the like in a generally linear element arrangement such that the framework may make up a series of interconnected triangles, squares, pentagons, hexagons, polygons, or the like. The framework structure may provide a lightweight structural support system within a finished instrument to reduce material use and the overall weight of the instrument to reduce fatigue for a user holding the instrument or supporting the instrument by strap or handle.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A complete understanding of the present embodiments and the advantages and features thereof will be more readily understood by reference to the following detailed description, appended claims, and accompanying drawings, wherein:

Figure 2:
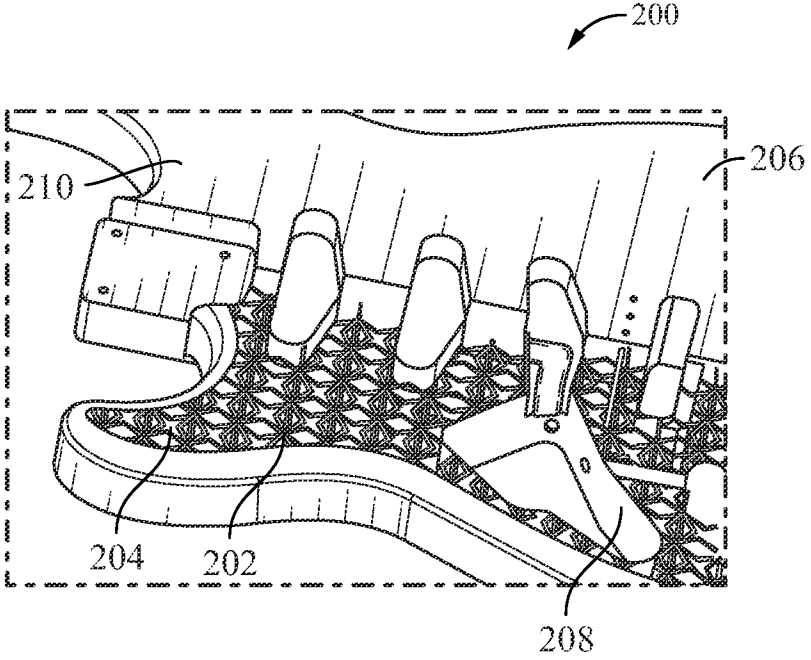
FIG. 2 illustrates a partial cross-sectional view of one variation of a hybrid material construction of string instruments consistent with this disclosure.

The drawings are not necessarily to scale, and certain features and certain views of the drawings may be shown exaggerated in scale or in schematic in the interest of clarity and conciseness.

DETAILED DESCRIPTION

The specific details of the single embodiment or variety of embodiments described herein are to the described apparatus. Any specific details of the embodiments are used for demonstration purposes only, and no unnecessary limitations or inferences are to be understood therefrom.

Before describing in detail exemplary embodiments, it is noted that the embodiments reside primarily in combinations of components and procedures related to the apparatus. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

The specific details of a variety of embodiments described herein are set forth in this application. Any specific details of the embodiments are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

A hybrid-material construction for string instruments may include an internal lattice framework structure encased in a composite material to produce a final form of a string instrument. The internal framework may include rigid yet flexible materials such as metals or composites. The internal framework may consist of rods, beams, posts, tubes, columns, or the like in a generally linear element arrangement such that the framework includes rods, beams, posts, tubes, columns, or the like forming arrangements such as interconnected triangles, squares, pentagons, hexagons, polygons, or the like. The framework structure may provide a lightweight structural support system within a finished instrument to reduce overall weight, thereby reducing fatigue for a user holding the instrument or supporting the instrument by strap or handle.

According to some embodiments, the framework may be assembled or may be manufactured by additive means, such as being 3-D printed as a single structure. Alternatively, the framework may include a plurality of independent internal frameworks distinct from one another but in aggregate providing increased strength to an instrument while reducing weight.

Figure 1:
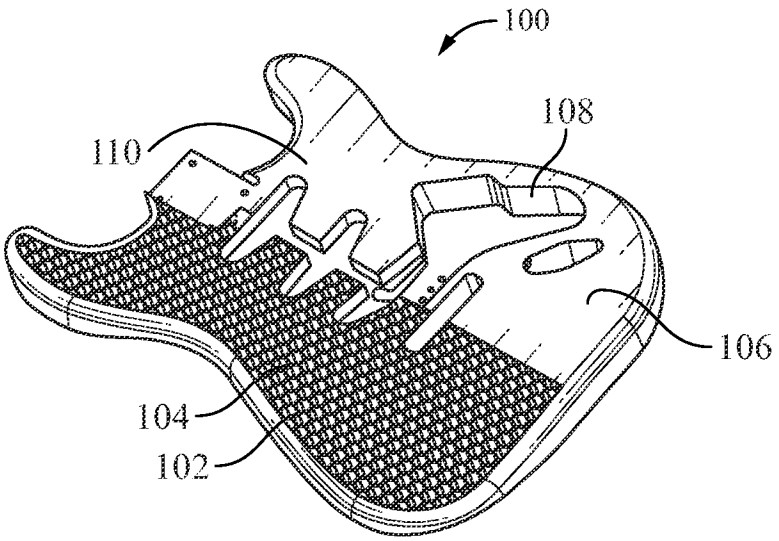
FIG. 1 illustrates a partial cross-sectional view of one variation of a hybrid material construction of string instruments consistent with this disclosure.

FIG. 1 illustrates a partial cross-sectional view of one variation of a hybrid material construction of string instruments 100 including a lattice framework 102 defining a plurality of cavities 104 encased in a body 106 such that a lightweight string instrument body 106 is formed. According to some embodiments, the body 106 may define a hollow core in which the lattice framework 102 may be seated in order to further reduce the weight of the instrument. The body 106 may define various body cavities 108 appropriate for the string instrument to be made. The string instrument may include a surface coating 110 such as paint, clear coating, or protective coating. The body 106 may make up the body portion of a guitar including cavities arranged to house pick guards, pickups, bridges, switches, knobs, or auxiliary jacks.

FIG. 2 illustrates a partial cross-sectional view of one variation of a hybrid material construction of string instruments 200 including a lattice framework 202 defining a plurality of cavities 204 encased in a body 206 such that a lightweight string instrument body 206 is formed. The body 206 may define various body cavities 208 appropriate for the string instrument to be made or house pick guards, pickups, bridges, switches, knobs, or auxiliary jacks. The string instrument may include a surface coating 210 such as paint, clear coating, or protective coating.

Figure 3A:
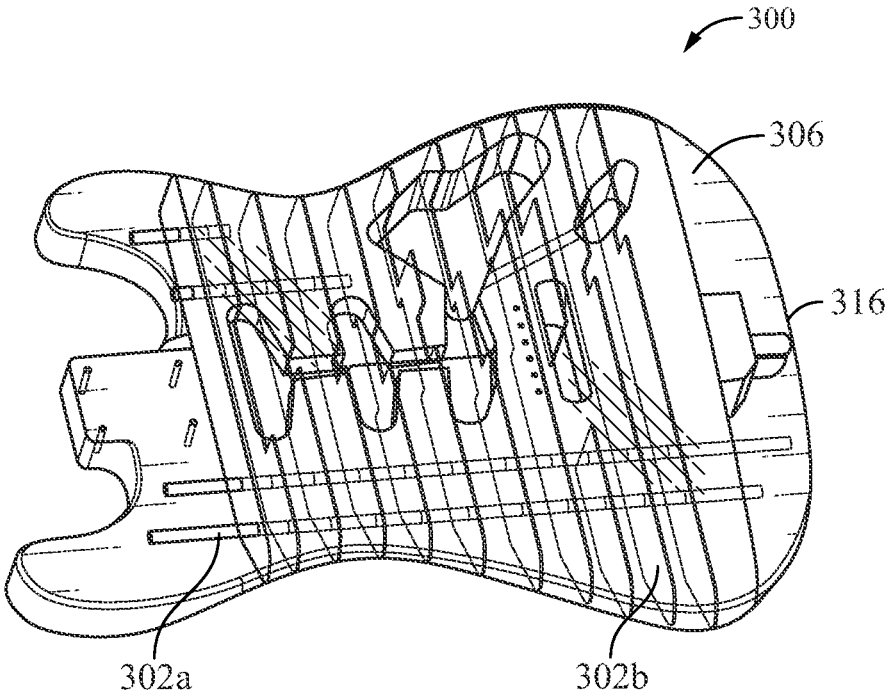
FIG. 3A illustrates a perspective transparent view of one variation of a hybrid material construction of string instruments consistent with this disclosure.

FIG. 3A illustrates a perspective transparent view of one variation of a hybrid material construction of string instruments 300 including a framework made up of at least one rod 302*a* and cross-members 302*b* in mechanical communication with one another. The framework may be encased in a body 306 such that a lightweight string instrument body 306 is formed. The string instrument 300 may include a body profile 316 made up of an encasing material such that the framework is not exposed to the atmosphere.

Figure 3B:
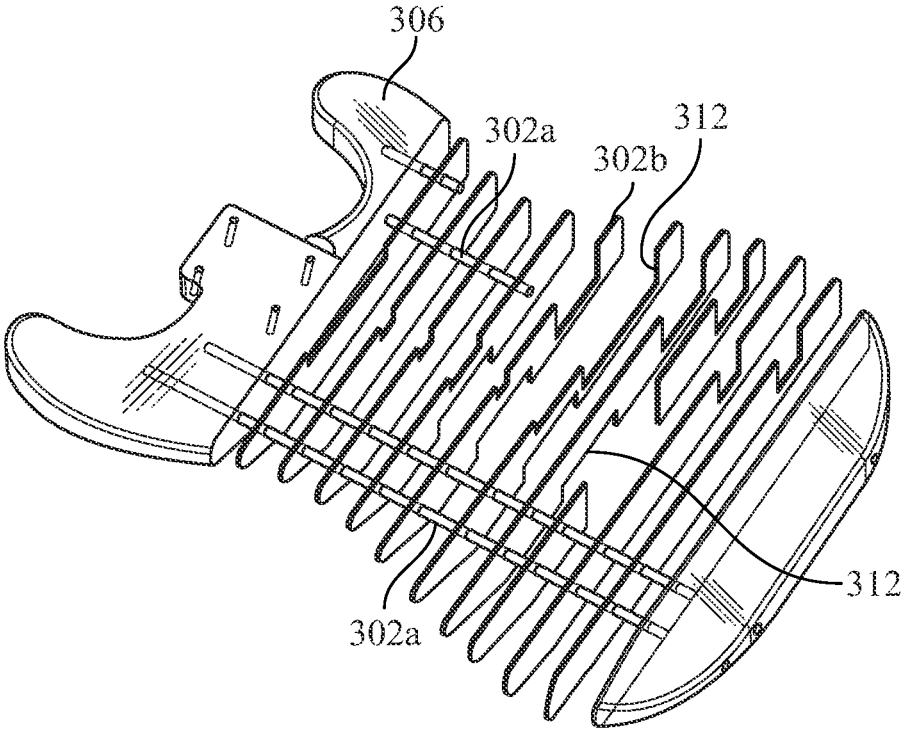
FIG. 3B illustrates a perspective exploded transparent view of one variation of a hybrid material construction of string instruments consistent with this disclosure.

FIG. 3B illustrates a perspective exploded transparent view of one variation of a hybrid material construction of string instruments including a framework made up of at least one rod 302*a* and cross-members 302*b* in mechanical communication with one another. The framework may define recesses 312 constructed and arranged to facilitate attachment to the subsequently formed body 306, or to facilitate installation of additional components to the instrument such as pick guards, pickups, bridges, switches, knobs, or auxiliary jacks.

Figure 3C:
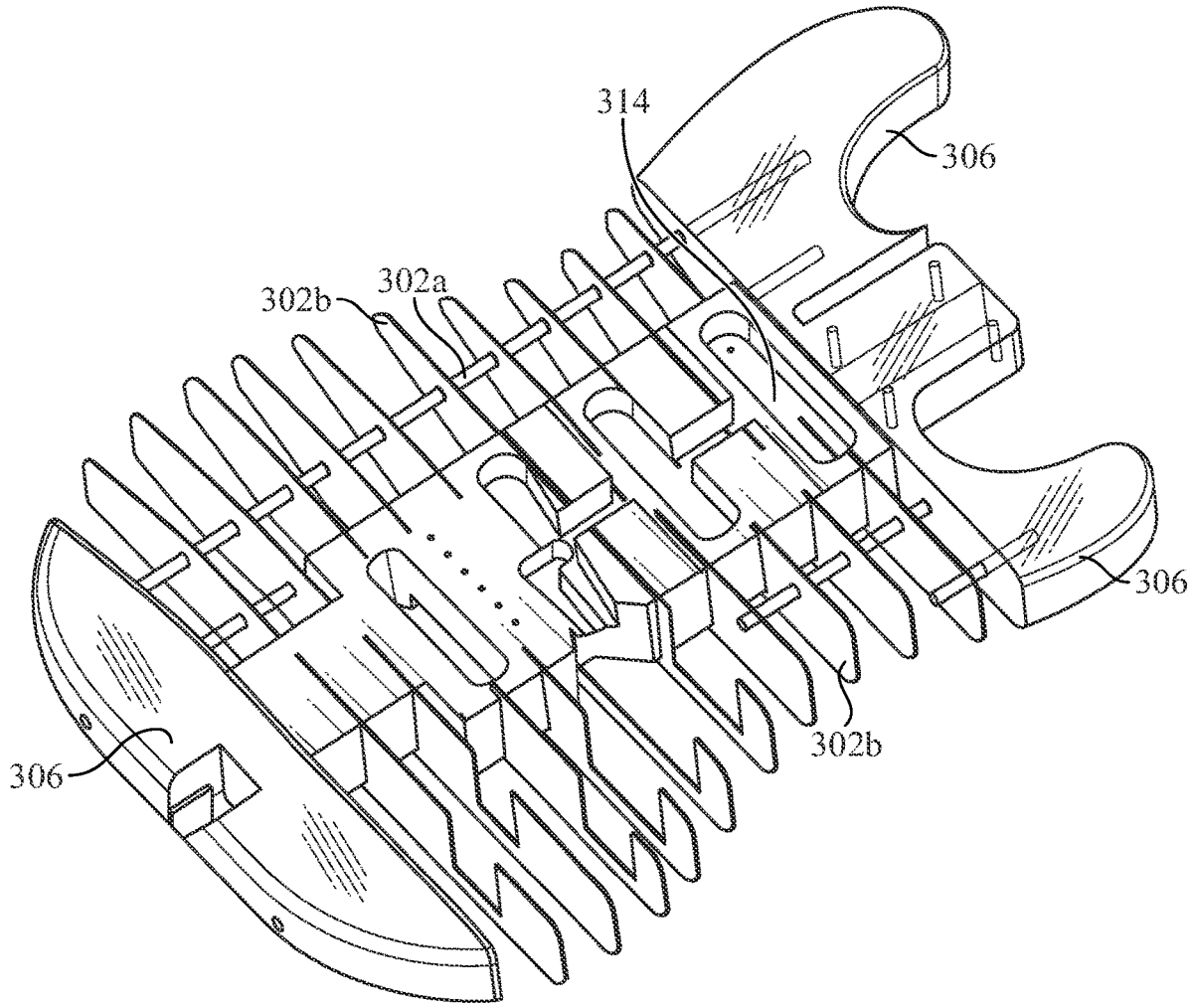
FIG. 3C illustrates a perspective exploded transparent view of one variation of a hybrid material construction of string instruments consistent with this disclosure.

FIG. 3C illustrates a perspective exploded transparent view of one variation of a hybrid material construction of string instruments including a framework made up of at least one rod 302*a* and cross-members 302*b* in mechanical communication with one another. The framework may define cavities or recesses 312 constructed and arranged to facilitate attachment to the subsequently formed body 306, or to facilitate installation of additional components 314 to the instrument which may be mechanically mated to the rod 302*a*, cross-members 302*b*, or recesses 312. According to some embodiments, component 314 may include a wood center body or center body made of an appropriate material for instrument tone. According to some embodiments, component 314 may be pre-formed or integrated with the body 306 as a multipiece or single piece construction. The framework made up of rods 302*a* and cross-members 302*b* may be installed within the hybrid material construction string instrument to reduce material use and the overall weight of the instrument. According to some embodiments, the component 314 may be affixed to or integrated with the neck of a guitar. Recesses 312 may include recesses defined to seat or house pick guards, pickups, bridges, switches, knobs, or auxiliary jacks. According to some embodiments, the hybrid material construction string instrument may include a framework, a body, and additional components 314 such as a second body including a third material.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

According to variation 1, a hybrid material construction string instrument may include a lattice framework defining a plurality of cavities and a body encasing the lattice framework and at least partially filling the plurality of cavities.

Variation 2 may include a hybrid material construction string instrument as in variation 1 wherein the lattice framework includes at least one of rods, beams, posts, tubes, or columns.

Variation 3 may include a hybrid material construction string instrument as in any of variations 1 through 2 wherein the lattice framework includes at least one of rods, beams, posts, tubes, or columns forming at least one of triangles, squares, pentagons, hexagons, or polygons defining the plurality of cavities.

Variation 4 may include a hybrid material construction string instrument as in any of variations 1 through 3 further including a second body at least partially encased by the lattice framework and body.

Variation 5 may include a hybrid material construction string instrument as in any of variations 1 through 4 wherein the lattice framework includes a first material and the body includes a second material.

Variation 6 may include a hybrid material construction string instrument as in any of variations 1 through 5 wherein the lattice framework includes at least one of interconnected rods, beams, posts, tubes, or columns and a plurality of cross-members.

Variation 7 may include a hybrid material construction string instrument as in any of variations 1 through 6 wherein the plurality of cross-members define a plurality recesses.

Variation 8 may include a hybrid material construction string instrument as in any of variations 1 through 7 wherein the plurality recesses are constructed and arranged to at least partially house at least one of a pick guard, pickup, bridge, switch, knob, or auxiliary jack.

Variation 9 may include a hybrid material construction string instrument as in any of variations 1 through 8 wherein the body defines a hollow in which the lattice framework is disposed.

According to variation 10, a hybrid material construction string instrument may include an additive manufactured lattice framework including a first material and defining a plurality of minor cavities and a guitar body including a second material and defining a hollow cavity in which the lattice framework is disposed.

Variation 11 may include a hybrid material construction string instrument as in variation 10 wherein the lattice framework includes at least one of interconnected rods, beams, posts, tubes, or columns.

Variation 12 may include a hybrid material construction string instrument as in any of variations 10 through 11 wherein the lattice framework includes at least one of rods, beams, posts, tubes, or columns forming at least one of triangles, squares, pentagons, hexagons, or polygons defining the plurality of minor cavities.

Variation 13 may include a hybrid material construction string instrument as in any of variations 10 through 12 further including a second body at least partially encased by the lattice framework and body.

Variation 14 may include a hybrid material construction string instrument as in any of variations 10 through 13 wherein the lattice framework includes at least one of interconnected rods, beams, posts, tubes, or columns and a plurality of cross-members.

Variation 15 may include a hybrid material construction string instrument as in any of variations 10 through 14 wherein the plurality of cross-members define a plurality recesses.

Variation 16 may include a hybrid material construction string instrument as in any of variations 10 through 15 wherein the plurality recesses are constructed and arranged to at least partially house at least one of a pick guard, pickup, bridge, switch, knob, or auxiliary jack.

Variation 17 may include a hybrid material construction string instrument as in any of variations 10 through 16 further including a second body including a third material, the second body seated within at least a portion of the guitar body.

According to variation 18, a hybrid material construction string instrument may include a guitar body including a first material and defining a first recess and defining a hollow cavity therein; a second body including a second material, the second body disposed within the first recess; and a lattice framework including a third material disposed within the hollow cavity, the lattice framework including at least one of interconnected rods, beams, posts, tubes, or columns and a plurality of cross-members to reduce overall weight of the hybrid material construction string instrument.

Variation 19 may include a hybrid material construction string instrument as in variation 18 wherein the lattice framework includes an interconnected plurality of at least one of rods, beams, posts, tubes, columns, or cross-members.

Variation 20 may include a hybrid material construction string instrument as in any of variations 18 through 19 wherein the hybrid material construction string instrument is a guitar body.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A hybrid material construction string instrument comprising:

a lattice framework defining a plurality of cavities and comprising at least one of interconnected rods, beams, posts, tubes, or columns; and a body encasing the lattice framework and a second body and at least partially filling the plurality of cavities.

2. A hybrid material construction string instrument as in claim 1 wherein the lattice framework comprises at least one of rods, beams, posts, tubes, or columns.

3. A hybrid material construction string instrument as in claim 1 wherein the lattice framework comprises at least one of rods, beams, posts, tubes, or columns forming at least one of triangles, squares, pentagons, hexagons, or polygons defining the plurality of cavities.

4. A hybrid material construction string instrument as in claim 1 wherein the second body is at least partially encased by the lattice framework and the body.

5. A hybrid material construction string instrument as in claim 1 wherein the lattice framework comprises a first material and the body comprises a second material.

6. A hybrid material construction string instrument as in claim 5 wherein the plurality of cross-members define a plurality recesses.

7. A hybrid material construction string instrument as in claim 5 wherein the plurality recesses are constructed and arranged to at least partially house at least one of a pick guard, pickup, bridge, switch, knob, or auxiliary jack.

8. A hybrid material construction string instrument as in claim 1 wherein the body defines a hollow in which the lattice framework is disposed.

9. A hybrid material construction string instrument comprising:

an additive manufactured lattice framework comprising a first material and defining a plurality of minor cavities, the additive manufactured lattice framework comprising a plurality of cross-members at least one of interconnected rods, beams, posts, tubes, or columns; and a guitar body comprising a second material and defining a hollow cavity in which the lattice framework and a second body is disposed.

10. A hybrid material construction string instrument as in claim 9 wherein the lattice framework comprises at least one of interconnected rods, beams, posts, tubes, or columns.

11. A hybrid material construction string instrument as in claim 9 wherein the lattice framework forms at least one of triangles, squares, pentagons, hexagons, or polygons defining the plurality of minor cavities.

12. A hybrid material construction string instrument as in claim 9 wherein the second body is at least partially encased by the lattice framework and body.

13. A hybrid material construction string instrument as in claim 12 wherein the plurality of cross-members define a plurality of recesses.

14. A hybrid material construction string instrument as in claim 12 wherein the plurality recesses are constructed and arranged to at least partially house at least one of a pick guard, pickup, bridge, switch, knob, or auxiliary jack.

15. A hybrid material construction string instrument as in claim 9 wherein the second body comprises a third material, the second body seated within at least a portion of the guitar body.

16. A hybrid material construction string instrument comprising:

a guitar body comprising a first material and defining a first recess and defining a hollow cavity therein;

a second body comprising a second material, the second body disposed within the first recess; and a lattice framework comprising a third material disposed within the hollow cavity, the lattice framework comprising at least one of interconnected rods, beams, posts, tubes, or columns and a plurality of cross-members to reduce overall weight of the hybrid material construction string instrument.

17. A hybrid material construction string instrument as in claim 16 wherein the lattice framework comprises an interconnected plurality of at least one of rods, beams, posts, tubes, columns, or cross-members.

18. A hybrid material construction string instrument as in claim 16 wherein the hybrid material construction string instrument is a guitar body.

* * * * *